US006175355B1

(12) United States Patent
Reddy

(10) Patent No.: US 6,175,355 B1
(45) Date of Patent: Jan. 16, 2001

(54) DISPERSION-BASED TECHNIQUE FOR MODULATING PIXELS OF A DIGITAL DISPLAY PANEL

(75) Inventor: Dayakar Chandram Reddy, San Jose, CA (US)

(73) Assignee: National Semiconductor Corporation, Santa Clara, CA (US)

( * ) Notice: Under 35 U.S.C. 154(b), the term of this patent shall be extended for 0 days.

(21) Appl. No.: 08/893,872

(22) Filed: Jul. 11, 1997

(51) Int. Cl.[7] ..... G09G 5/10
(52) U.S. Cl. ..... 345/148; 345/147; 345/89
(58) Field of Search ..... 345/147, 148, 345/149, 58, 89, 99

(56) References Cited

U.S. PATENT DOCUMENTS

| | | | | |
|---|---|---|---|---|
| 4,709,995 | | 12/1987 | Kuribayashi et al. | 350/350 S |
| 4,747,671 | | 5/1988 | Takahashi et al. | 350/336 |
| 5,185,602 | * | 2/1993 | Bassetti, Jr. et al. | 345/89 |
| 5,293,159 | | 3/1994 | Bassetti, Jr. et al. | 345/149 |
| 5,298,915 | | 3/1994 | Bassetti, Jr. | 345/149 |
| 5,404,427 | | 4/1995 | Cawley et al. | 395/131 |
| 5,455,600 | | 10/1995 | Friedman et al. | 345/153 |
| 5,469,190 | | 11/1995 | Masterson | 345/155 |
| 5,479,188 | * | 12/1995 | Moriyama | 345/147 |
| 5,495,346 | | 2/1996 | Choi et al. | 358/457 |
| 5,508,822 | | 4/1996 | Ulichney et al. | 358/457 |
| 5,553,200 | | 9/1996 | Accad | 395/109 |
| 5,586,203 | | 12/1996 | Spaulding et al. | 382/270 |
| 5,619,230 | | 4/1997 | Edgar | 345/150 |
| 5,621,825 | | 4/1997 | Masaki et al. | 382/274 |
| 5,673,065 | | 9/1997 | DeLeeuw | 345/153 |
| 5,818,419 | | 10/1998 | Tajima et al. | 345/147 |
| 5,896,122 | | 4/1999 | MacDonald et al. | 345/153 |

FOREIGN PATENT DOCUMENTS

| | | | |
|---|---|---|---|
| 0 654 777 A1 | 5/1995 | (EP) | G09G/3/34 |

* cited by examiner

*Primary Examiner*—Kent Chang
(74) *Attorney, Agent, or Firm*—Limbach & Limbach L.L.P.

(57) ABSTRACT

A technique for modulating pixels of a display panel for forming an image. Each pixel has an associated pixel frame, which is a period of time during which the pixel is modulated to achieve an appropriate greyscale level for the pixel. Each pixel frame includes a plurality of sub-frames. During each of the sub-frames, the pixel is placed in 'on' condition or in an 'off' condition according to a selected one of a plurality of predetermined greyscale sequences. Each greyscale sequence corresponds to a greyscale level for the pixel frame. A display frame is formed when each pixel in the display is appropriately modulated according to an image to be displayed. The displayed image is continually updated by displaying a sequence of display frames. The display panel is divided into blocks of sixteen pixels arranged in a four-by-four array. The greyscale sequences for pixels in a block are offset from one another by various numbers of sub-frames. This offset is termed pixel dispersion. The pixel blocks are grouped in four-by-four arrays of sixteen pixel blocks. Greyscale sequences for modulating the pixels in a block are offset from sequences for pixels in other blocks in the array by various numbers of sub-frames. This offset is termed block dispersion. Multiple arrays of blocks are updated in an identical manner to form a complete display panel.

10 Claims, 5 Drawing Sheets

DISPERSION-BASED TECHNIQUE FOR MODULATING PIXELS OF A DIGITAL DISPLAY PANEL

FIELD OF THE INVENTION

This invention relates to the field of modulating pixels of a display panel for forming a greyscale image on the display. More particularly, the invention relates to the field of dispersing over time a sequence for modulating each pixel of a display panel for forming a greyscale image on the display.

BACKGROUND OF THE INVENTION

A collection of pixels is modulated for displaying an image on a digital display, a pixel is either in an 'on' condition or in an 'off' condition. For example, the 'on' condition can represent white and the 'off' condition can represent black. To provide more information and realism in the image, it is generally desired to provide intermediate intensities or greyscale levels. Pulse width modulation (PWM) is a well known technique for achieving intermediate greyscale levels. According to PWM, the pixels are rapidly toggled a varying portion of the time between 'on' and 'off'. The larger the percentage of time the pixel is 'on', the closer to white the pixel is displayed. Assuming the clock rate is sufficiently fast, a viewer's eye integrates the intensity of a toggled pixel to perceive grey rather than merely black or white. The intensity level for the pixel depends upon the relative durations of the 'on' state and the 'off' state. It is well understood that pulse-width modulation can also be applied to color systems for forming varying intensities and shades of color.

Digital display systems generally include a plurality of pixels arranged in an array of rows and columns. Conventionally, a row of image data to be displayed is loaded from a video memory into a shift register and then utilized to pulse-width modulate each pixel in a corresponding row of a display panel according to the data in the register. Modulation for each row of pixels is generally performed in a regular sequence beginning with a left-most pixel in the row and ending with a right-most pixel. Once the row is complete, image data for a next row of pixels is loaded into the register. According to prior art systems, this process repeats for each row in the display, thus, forming a complete frame. Once the frame is completed, the image is continually updated by repeating this process.

A drawback to this conventional display system is that because the pixels are modulated in a regular sequence and in the order in which they appear in the display, the updating process can induce false motion artifacts into the image. For example, lines can appear to move in the image or the image can appear to flicker, especially in the presence of fluorescent lighting systems.

What is needed is a technique for updating a digital display system with image data according to a pulse-width modulation technique that does not induce motion artifacts into the image.

SUMMARY OF THE INVENTION

The invention is a dispersion-based technique for modulating pixels of a digital display panel for forming an image on the display panel. The display panel includes a plurality of pixels arranged in rows and in columns. Each pixel has an associated pixel frame, which is a period of time during which the pixel is modulated to achieve an appropriate greyscale level for the pixel. Each pixel frame includes a plurality of sub-frames. During each of the sub-frames, the pixel is configured in an 'on' condition or in an 'off' condition according to a selected one of a plurality of predetermined greyscale sequences. Each PWM greyscale sequence corresponds to a greyscale level for the pixel frame. A display frame is formed when each pixel in the display is appropriately modulated according to an image to be displayed. The displayed image is continually updated by displaying a next display frame in a sequence of display frames.

Sequences for modulating the pixels are spatially and temporally dispersed in a non-regular sequence to reduce or eliminate motion artifacts introduced into the displayed image by the process of updating the image. This is accomplished by dividing the display panel into blocks of pixels. Each pixel block preferably includes sixteen pixels arranged in a four-by-four array. The greyscale sequences for pixels in a block are offset from one another by various numbers of sub-frames. This offset is termed pixel dispersion. The amount of pixel dispersion is preferably not related to an order in which the pixels are arranged in rows and columns within the blocks. The pixel blocks are grouped in four-by-four arrays of sixteen pixel blocks. Greyscale sequences for modulating the pixels in a block are offset from sequences for pixels in other blocks in the array by various numbers of sub-frames. This is termed block dispersion. The amount of block dispersion is preferably not related to an order in which the blocks are arranged in rows and columns in the array of blocks. Multiple arrays of blocks are updated in an identical manner to form a complete display panel.

DETAILED DESCRIPTION OF A PREFERRED EMBODIMENT

Figure 1:
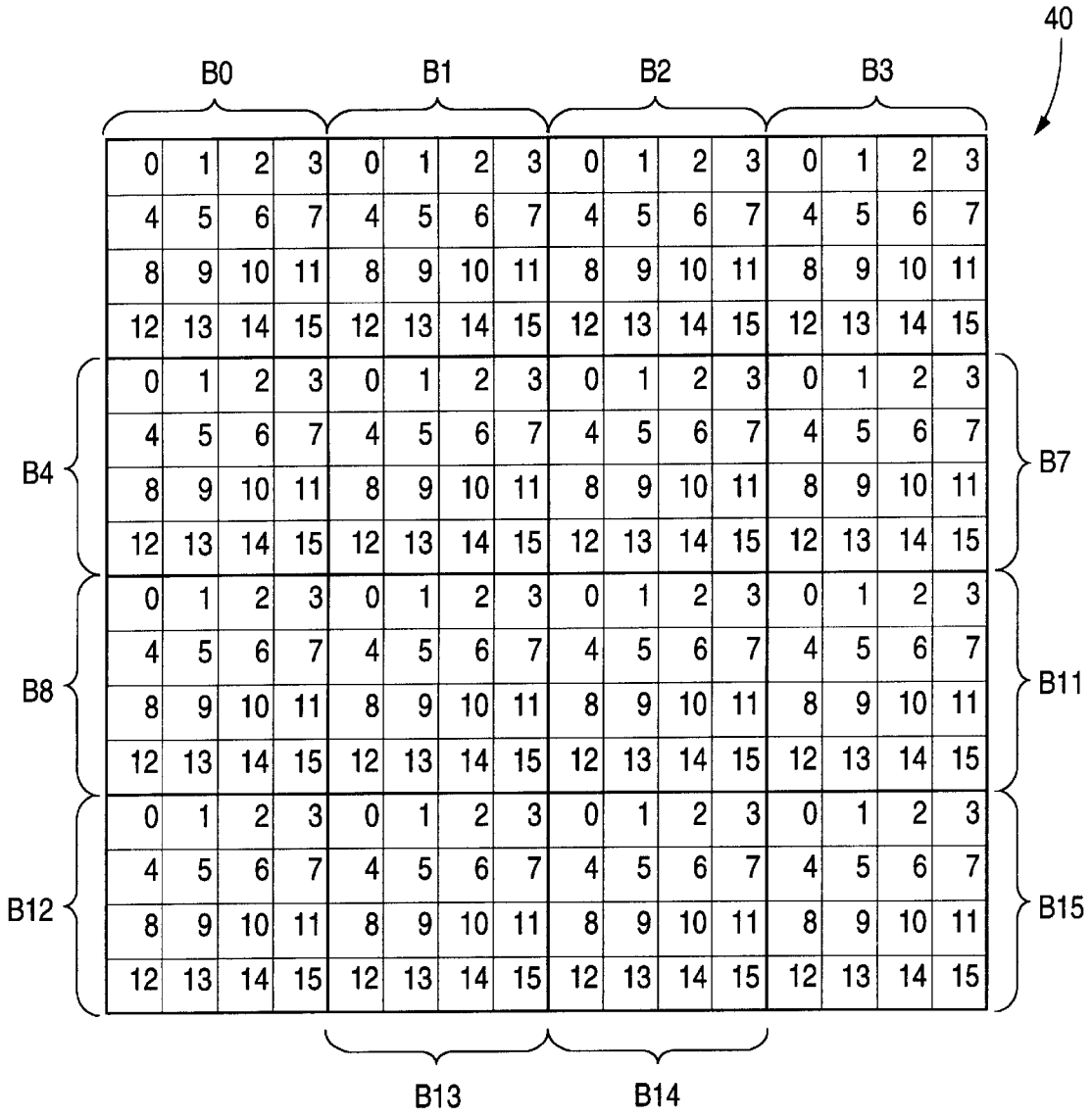
FIG. 1 illustrates a diagram of a portion of a digital display panel divided according to the present invention into a four-by-four array of sixteen blocks.

FIG. 1 illustrates a diagram of a portion of a digital display panel divided according to the present invention into a four-by-four array A0 of sixteen blocks B0–B15. Each block B0–B15 includes sixteen pixels 0–15 arranged in a four-by-four array. Accordingly, the four-by-four block array A0 includes a total of 256 pixels. It will be apparent, however, that portions of the display panel can be divided into blocks or groups of pixels which include a different number of pixels positioned in different arrangements while achieving advantages of the present invention.

Figure 2:
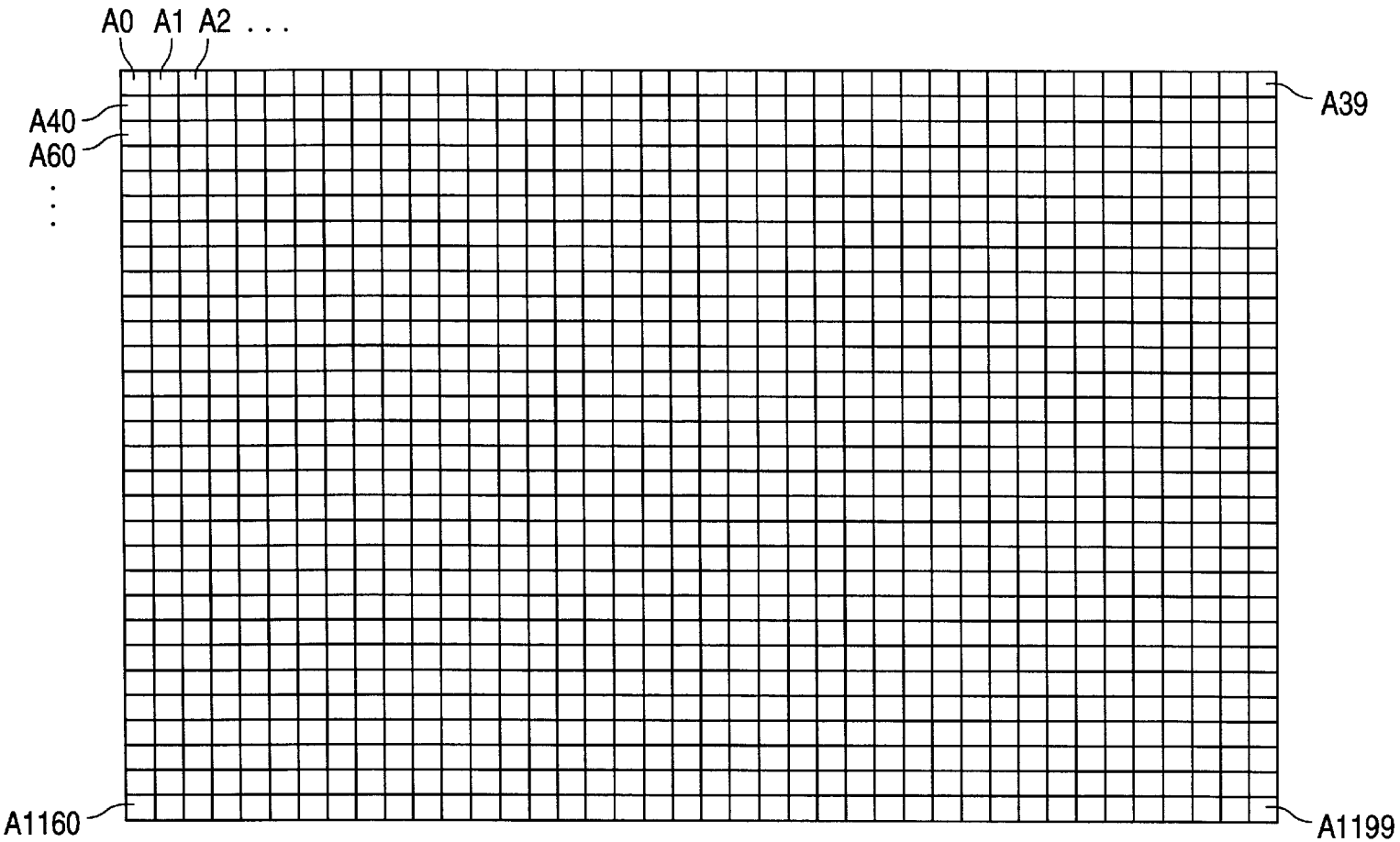
FIG. 2 illustrates an exemplary display panel comprising a 40-by-30 display array of identical four-by-four block arrays.

A complete display panel is formed of multiples of the four-by-four block arrays A0. For simplicity of explanation, the following discussion will be directed toward a single block array A0. It will be apparent, however, that the present invention can be applied to a display panel comprising any number of block arrays by replicating the techniques described herein for the block array A0. For example, a display panel having 640 columns and 480 rows of pixels comprises a 40-by-30 array of identical four-by-four block arrays. Display data applied to a particular block array will depend upon the complete image to be displayed by the display panel and upon the position of the particular block array in the display panel. FIG. 2 illustrates an exemplary display panel comprising a 40-by-30 display array of identical four-by-four block arrays A0-A1 199.

Also, for simplicity of explanation, the following discussion will be directed toward a black and white (greyscale) display panel. Color display panels differ from black and white display panels in that color display panels generally include a group of three sub-pixels for each pixel, each sub-pixel corresponding to one of the primary colors, red, green or blue. Each of the three sub-pixels are individually modulated to provide a variable intensity for each of the three colors. A viewer's eye integrates the three color sub-pixels to virtually form a variety of colors. Typically, appropriately colored filters are placed over the sub-pixels to achieve a desired color for the pixel. It will be apparent that the present invention can be applied to color display panels by replicating the techniques described herein for a black and white pixel for each of the three sub-pixels that make up a color pixel.

Figure 3:
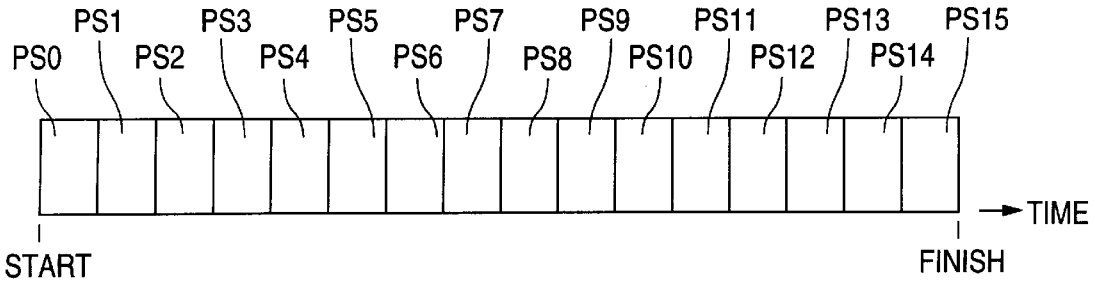
FIG. 3 illustrates a pixel frame according to the present invention.

Each pixel of the display panel has an associated pixel frame, which is a period of time during which the pixel is modulated to achieve an appropriate greyscale level for the pixel. FIG. 3 illustrates a pixel frame for a four bit binary weighted PWM scheme according to the present invention. As illustrated in FIG. 3, the pixel frame is preferably divided into sixteen pixel sub-frames PS0-PS15. It will be apparent, however, that more or fewer sub-frames can be utilized. During each sub-frame, the pixel is controlled to be in an 'on' condition (denoted herein by a '0') or in an 'off' condition (denoted herein by a '1') according to a selected one of a plurality of sequences (greyscale sequences). The greyscale sequences each correspond to a greyscale level for a pixel frame and are selected according to the image data to be displayed for the corresponding display frame. Table 1 gives exemplary greyscale sequences for each of the sixteen sub-frames of a pixel frame for forming varying shades of grey. It will be apparent, however, that other sequences can be used.

TABLE 1

| Grey Level | PS0–3 | PS4–7 | PS8–11 | PS12–15 |
|---|---|---|---|---|
| 0 (Black) | 0000 | 0000 | 0000 | 0000 |
| 1 | 0000 | 0000 | 0100 | 0000 |
| 2 | 0000 | 0001 | 0000 | 0001 |
| 3 | 0000 | 1000 | 0010 | 0001 |
| 4 | 0001 | 0001 | 0001 | 0001 |
| 5 | 0010 | 0100 | 0100 | 1001 |
| 6 | 0010 | 0101 | 0100 | 1001 |
| 7 | 0010 | 1010 | 0101 | 0101 |
| 8 (Medium-grey) | 0101 | 0101 | 0101 | 0101 |
| 9 | 1101 | 0101 | 0101 | 0101 |
| A | 1101 | 0101 | 1011 | 0110 |
| B | 1101 | 1011 | 1011 | 0110 |
| C | 1110 | 1110 | 1110 | 1110 |
| D | 1111 | 1110 | 1101 | 1110 |
| E | 1111 | 1110 | 1111 | 1110 |
| F (White) | 1111 | 1111 | 1111 | 1111 |

Figure 4:
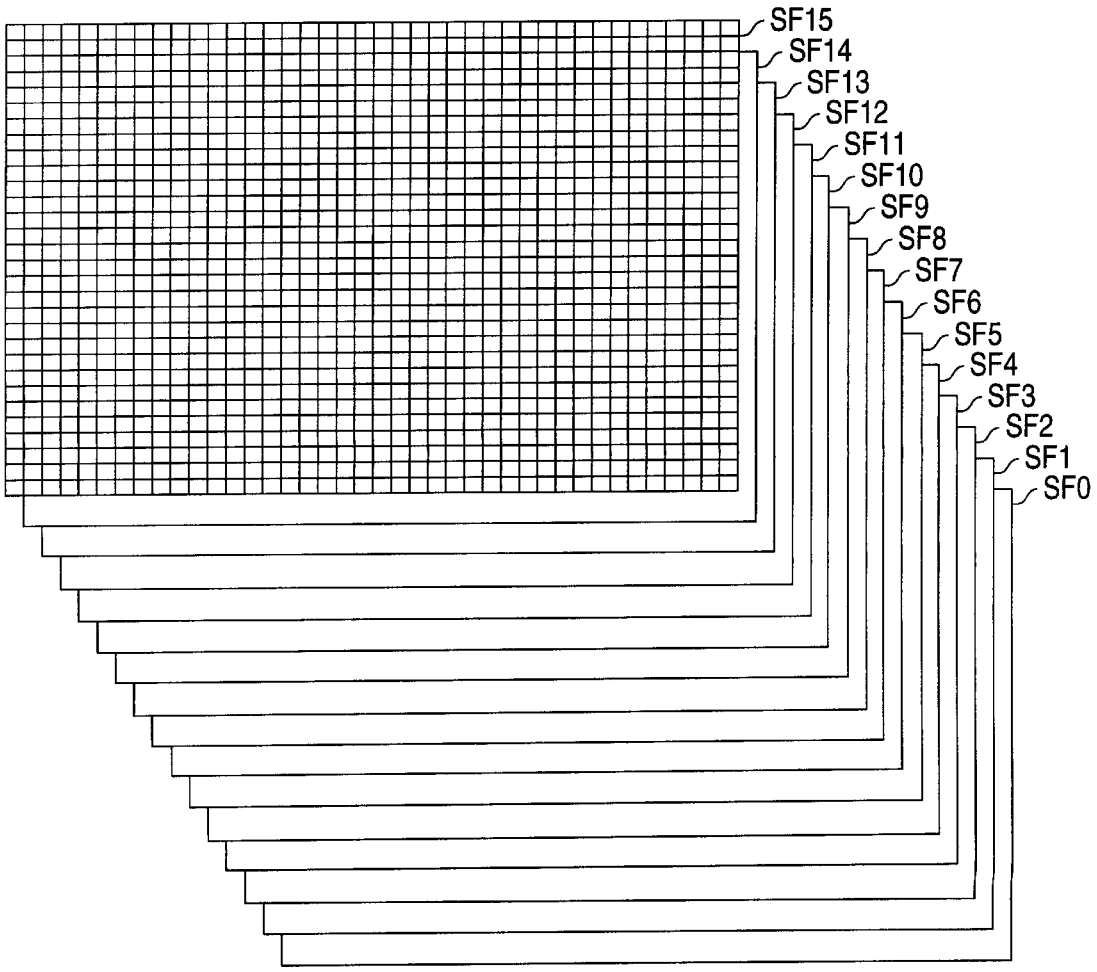
FIG. 4 illustrates a sequence of sixteen display sub-frames which form a complete display frame.

A complete display frame is formed when each pixel in the display is appropriately modulated according to an appropriate one of the grey levels given in Table 1. The grey level for a pixel is selected according to data representative of an image to be displayed during the display frame. Thus, even though the weighting is configured according to a binary weighted scheme, the 'on' bits having a duration longer than a single sub-frame are broken among the various sub-frames according to Table 1. A complete display frame includes a sequence of sixteen display sub-frames. FIG. 4 illustrates a sequence of sixteen display sub-frames SF0–SF15 which form a complete display frame. Each display sub-frame SF0–SF15 includes one pixel sub-frame for each pixel in the display. Thus, the display sub-frame is formed by appropriately conditioning each pixel in the display to be in an 'on' condition or in an 'off' condition for a period of time equal to the duration of a pixel sub-frame. The displayed image is continually updated (and the display panel refreshed) by displaying a next display frame in a sequence of display frames.

According to the present invention, sequences of pixel sub-frames are spatially and temporally dispersed to reduce motion artifacts introduced into the displayed image by the process of updating the image. The sequences of pixel sub-frames are disbursed by assigning an offset value to each pixel. As indicated above, for a complete display frame, each pixel 0–15 in a block B0–B15 is modulated according to an appropriate one of the grey levels given in Table 1. Each grey level in Table 1 represents a sequence (greyscale sequence) of sub-frames for a pixel. When the sequence of sub-frames for the pixel begins with PS0 and ends with PS15, the sequence is considered to have zero offset. Each sequence of sub-frames for a pixel begins with a sub-frame corresponding to the amount of offset assigned to the pixel. Dispersion offset values are added to the starting sub-frame in Modulo 15 arithmetic. For example, a sequence having an offset value of two begins with PS2 and ends with PS1 (where PS0 follows PS15). As another example, a sequence having an offset value of seven begins with PS7 and ends with PS6. Each pixel 0–15 in a block B0–B15 is assigned an offset value (referred to herein as a pixel dispersion value) relative to the other pixels in the block B0–B15. Preferably, each like numbered pixel is assigned the same pixel dispersion value. For example, each pixel numbered 6 in each block B0–B 15 is assigned the same pixel dispersion value.

Further, each block B0–B15 is assigned an offset value (referred to herein as a block dispersion value) relative to the other blocks B0–B15. The dispersion value assigned to a block is added to the pixel dispersion value assigned to each the pixel in the block to achieve a total offset value (total dispersion value) for the pixel. The total dispersion for a pixel is relative to the sub-frame sequences given in Table 1. For example, referring to FIG. 1, if all the pixels numbered 2 in the blocks B0–B15 are assigned a pixel dispersion value of four and block B6 is assigned a block dispersion value of two, the total dispersion for the pixel 2 in block B6 is six (2+4=6). Thus, a display frame for this particular pixel will begin with PS6 and will end with PS5. Table 2 below provides pixel dispersion values, while Table 3 provides block dispersion values. While the dispersion values given in tables 2 and 3 are preferred for some display panels, it will be apparent that the advantages of the present invention can be achieved utilizing other dispersion values. Generally, for the best results, the dispersion values are selected according to the operational characteristics of a particular display panel.

TABLE 2

| Pixel Number | Dispersion Value E0–E15 (hexadecimal) |
|---|---|
| 0 | 0 |
| 1 | 7 |
| 2 | 4 |
| 3 | D |
| 4 | 5 |
| 5 | A |

TABLE 2-continued

| Pixel Number | Dispersion Value E0–E15 (hexadecimal) |
|---|---|
| 6 | 1 |
| 7 | 8 |
| 8 | E |
| 9 | 3 |
| 10 | 6 |
| 11 | B |
| 12 | F |
| 13 | C |
| 14 | 9 |
| 15 | 2 |

TABLE 3

| Block Number | Dispersion Value D0–D15 (hexadecimal) |
|---|---|
| B0 | 3 |
| B1 | 0 |
| B2 | 9 |
| B3 | 6 |
| B4 | F |
| B5 | C |
| B6 | 2 |
| B7 | 5 |
| B8 | B |
| B9 | 8 |
| B10 | E |
| B11 | 1 |
| B12 | 7 |
| B13 | 4 |
| B14 | D |
| B15 | A |

Figure 5A:
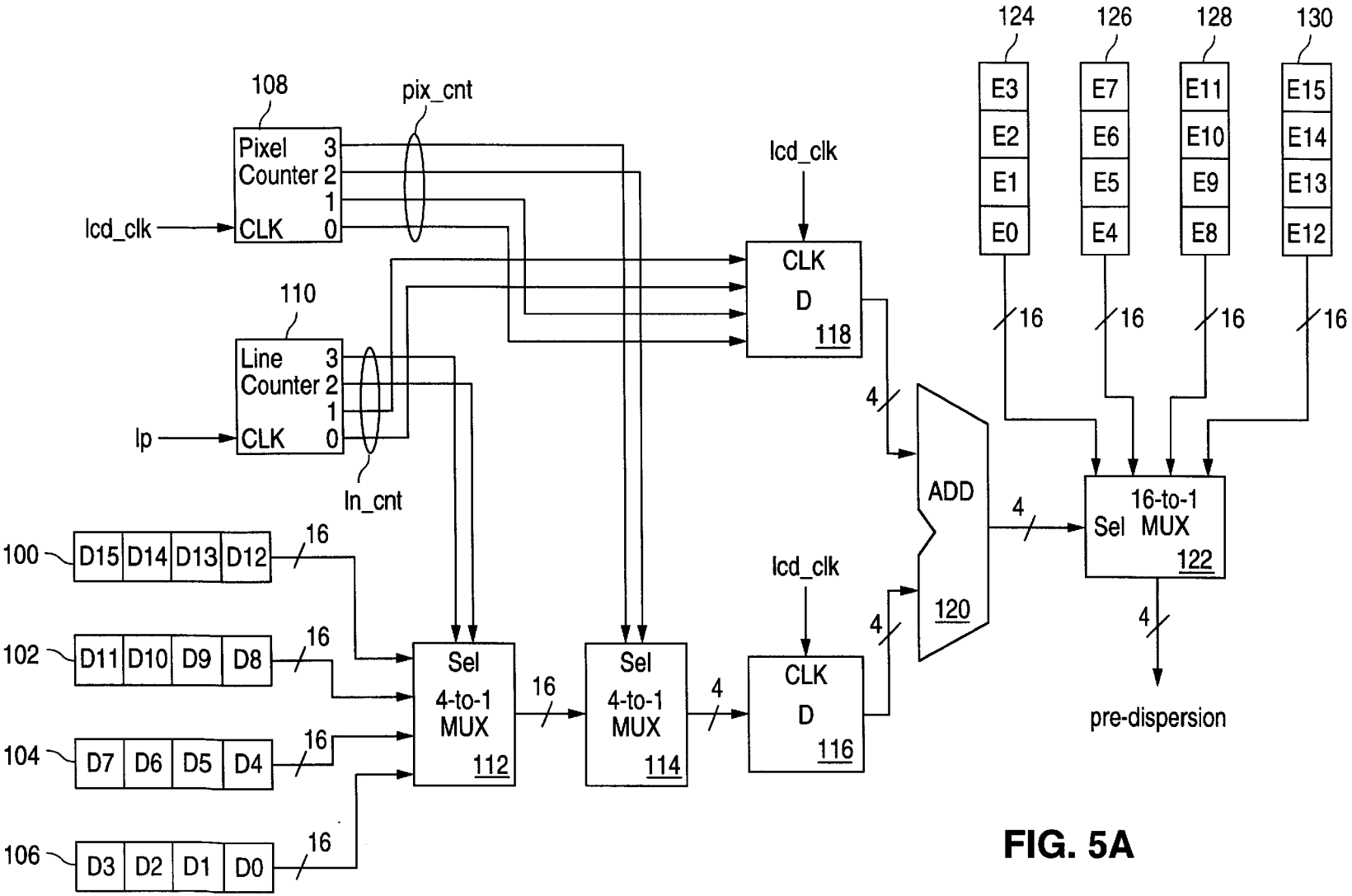
FIGS. 5A and 5B illustrate a block schematic diagram of a circuit for implementing the present invention.
Figure 5B:
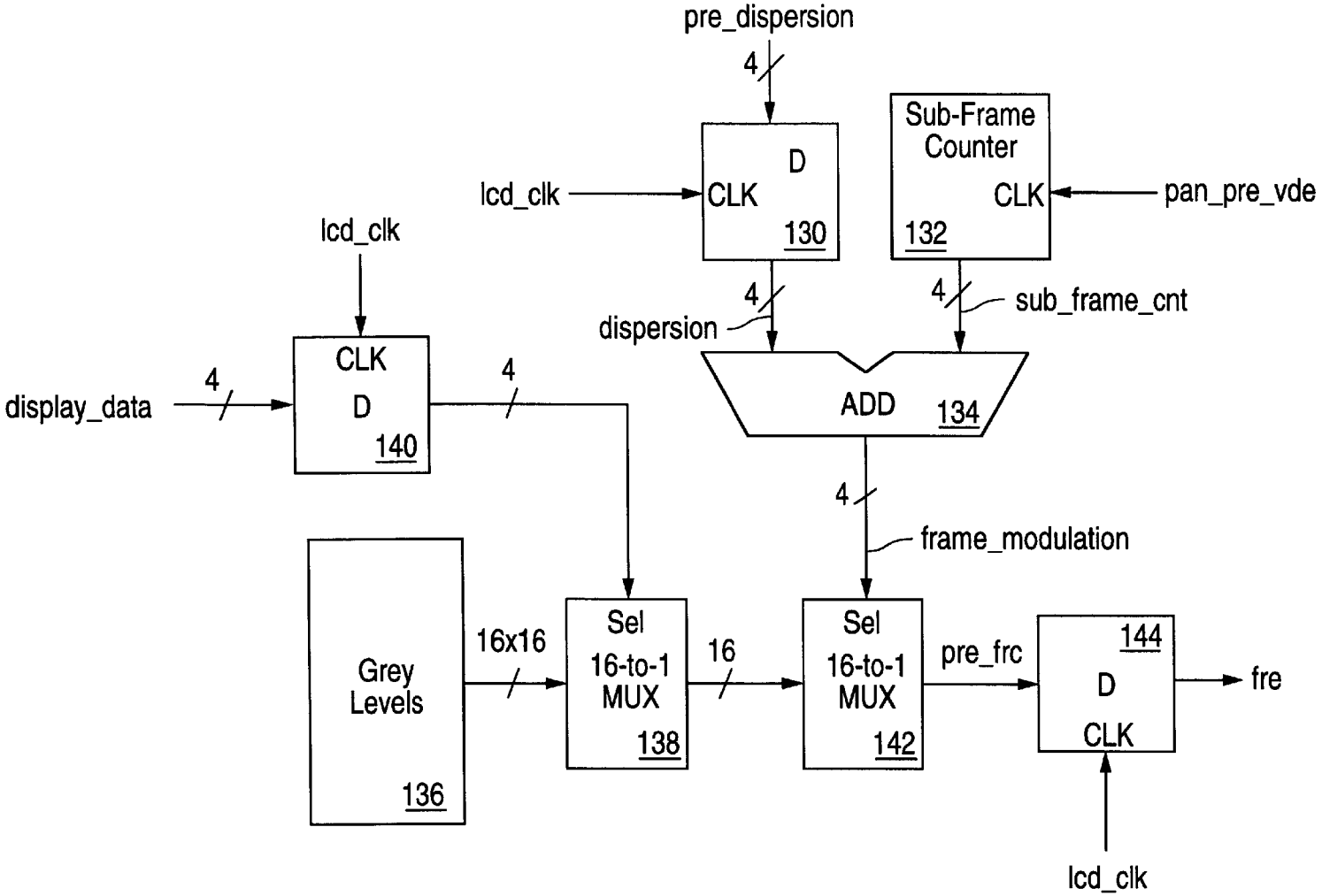

FIGS. 5A and 5B illustrate a block schematic diagram of a circuit for implementing the present invention. Referring to FIG. 5A, the dispersion values D0–D15 from Table 3 are stored in registers 100–106. Each of the registers 100–106 stores four dispersion values in sixteen memory cells. A pixel counter 108 counts cycles of a clock signal, lcd_clk, providing a four-bit pixel count value, pix_cnt. The clock signal, lcd_clk, is a clock signal for the display panel. A line counter 110 counts cycles of a clock signal, lp, providing a four-bit line count value, ln_cnt. The clock signal, lp, is incremented each time the value, pix_cnt, reaches 1111. It will be apparent that a block array of another size can be selected, in which case, the line count value, In_cnt, will be incremented accordingly. Together, the pixel counter 108 and line counter 110 uniquely identify a pixel by row and column in a four-by-four array A0 of blocks B0–B15.

The two most significant bits of the value, In_cnt, are coupled to a select input of a 4-to-1 multiplexer 112 for appropriately selecting the dispersion values stored in one of the registers 100–106. Thus, the four dispersion values stored in the selected register appear at the output of the multiplexer 112 as sixteen bits. The two most significant bits of the value, pix_cnt, are coupled to a select input of a 4-to-1 multiplexer 114 for appropriately selecting one of the four dispersion values appearing at the output of the multiplexer 112. Together, the two most significant bits of the value, pix_cnt, and the two most significant bits of the value, in_cnt, uniquely identify one of the blocks B0–B15 illustrated in FIG. 1. Thus, an appropriate one of the dispersion values D0–D15 is selected for each block B0–B15 to appear at the output of the multiplexer 114. The appropriate one of the dispersion values, D0–D15, appearing at the output of the multiplexer 114 is applied to the input of a delay flip-flop 116. The delay flip-flop is clocked according to the clock signal lcd_clk.

The two least significant bits of the value, pix_cnt, and the two least significant bits of the value, In_cnt, are applied to an input of a delay flip-flop 118 in concatenation. Together, the two least significant bits of the value, pix_cnt, and the two least significant bits of the value, In_cnt, uniquely identify one of the pixels 0–15 within each block B0–B15. The outputs of the delay flip-flops 116 and 118 are added together by an adder 120. Thus, the adder 120 adds a value representative of a pixel number within a block to a dispersion value for the block. The delay flip-flop 118 is clocked according to the clock signal lcd_clk. The flip-flops 116 and 118 ensure that data is applied to the inputs of the adder 120 is appropriately synchronized. The adder 120 provides a four bit sum at its output. Any carry resulting from the addition operation is discarded.

An output of the adder 120 is applied to a select input of a 16-to-1 multiplexer 122. The dispersion values E0–E0 from Table 2 are stored in registers 124–128. Each of the registers 124–128 stores four dispersion values in sixteen memory cells. The multiplexer 122 selects an appropriate one of the dispersion values E0–E0 to appear at its output, forming a four bit value, pre dispersion.

Referring to FIG. 5B, the value, pre_dispersion, is applied to an input of a delay flip-flop 130. The flip-flop 130 is clocked according to the clock signal lcd_clk. The output of the flip_flop 130 is a four bit value, dispersion, which is representative of a total amount of dispersion for the pixel identified by the values, pix_cnt and in_cnt. A sub-frame counter 132 counts cycles of a clock signal, pan_pre_vde, providing a four-bit sub-frame count value, sub-frame_count. The clock signal, pan_pre_vde, is incremented each time the line value, in_cnt reaches 1111. The output of the delay flip-flop 130 and the output of the sub-frame counter 132 are added together by an adder 134. The flip-flop 130 ensures that the value, dispersion, is synchronized with the value, sub_frame_count. The adder 134 provides a four bit sum, frame_modulation, at its output. Any carry resulting from the addition operation is discarded.

The values given in Table 1 for forming varying shades of grey are stored in a memory 136. Each group (greyscale sequence) of sixteen values is representative of a grey level and is stored in association with a four bit value specifying the grey level for the group, as given in Table 1. The memory 136 is coupled to a 16-to-1 multiplexer 138 such that a selected one of the groups of sixteen values appears at the output of the multiplexer 138 as a sixteen-bit binary number.

Data values, display data, representative of an image to be displayed during a display frame are applied to an input of a delay flip-flop 140. At any point in time, the value of display_data represents a grey level for the pixel identified by the values, ln_cnt and pix_cnt. The flip-flop 140 is clocked according to the clock signal, lcd_clk. An output of the flip_flop 140 is coupled to a select input of the multiplexer 138 for selecting an appropriate one of the grey levels for the pixel to appear at the output of the multiplexer 138.

The output of the multiplexer 138 is coupled to an input of 16-to-1 multiplexer 142, such that a selected one of the values of the group of sixteen values appears at the output of the multiplexer 142, as a one-bit binary number, pre_frc. The value, frame_modulation, formed by the adder 134 is coupled to a select input of the multiplexer 142 for appropriately selecting one of the values from the group of sixteen values to form the value, pre_frc. The value, pre_frc, indicates the appropriate condition, 'on' or 'off', for the pixel identified by the values, pix_cnt and ln_cnt, during the sub-frame identified by the value, sub-frame_cnt, and according to the total dispersion value assigned to the pixel. The output of the multiplexer 142 is coupled to an input of a delay flip-flop 144. The values, frc, are coupled to the display panel for appropriately conditioning each pixel in the display. The flip-flop 144 is clocked by the clock signal, lcd_clk to ensure that the values, frc, formed at the output of the flip-flop 144, are appropriately synchronized with the display panel.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention. Specifically, it will be apparent to one of ordinary skill in the art that the device of the present invention could be implemented in several different ways and the apparatus disclosed above is only illustrative of the preferred embodiment of the invention and is in no way a limitation.

What is claimed is:

1. A method of displaying a display image on a display panel having a plurality of pixels arranged in row and columns, the method comprising steps of:

a. dividing the display panel into first and second groups of pixels;

b. assigning a pixel modulation sequence to each pixel of the first and second groups according to the display image;

c. assigning pixel offset values to each pixel of the first and second groups;

d. assigning group offset values to each of the first and second groups; and e. modulating each pixel of the display according to the pixel modulation sequence assigned to the pixel wherein the pixel modulation sequence is offset by an amount equal to a sum of the pixel offset value assigned to the pixel and the group offset value assigned to the group which includes the pixel.

2. The method according to claim 1 wherein the first and second groups are each an arrangement of rows and columns of adjoining pixels.

3. The method according to claim 1 wherein the first and second groups include an equal number of pixels and wherein each pixel in the first group corresponds to a pixel in the second group and wherein corresponding pixels are assigned an equal pixel offset value.

4. The method according to claim 1 wherein the first and second groups include an equal number of pixels positioned in a same arrangement and wherein each pixel in the first group corresponds to a pixel in the second group having a same position in the arrangement and wherein corresponding pixels are assigned an equal pixel offset value.

5. A method of displaying a display image on a display panel having a plurality of pixels arranged in row and columns, the method comprising steps of:

a. dividing the display panel into a plurality of groups of pixels, wherein each group includes a plurality of adjoining pixels;

b. assigning a pixel modulation sequence to each of a plurality of grey levels to be displayed during a display frame;

c. assigning one of the plurality of grey levels to each pixel according to the display image;

d. assigning one of a first plurality of offset values to each pixel of the display;

e. assigning one of a second plurality of offset values to each group of pixels; and f. modulating each pixel of the display according to the pixel modulation sequence assigned to the grey level for the pixel wherein the pixel modulation sequence is offset by an amount equal to a sum of the offset value of the first plurality of offset values assigned to the pixel and the offset value of the second plurality of offset values assigned to the group which includes the pixel.

6. The method according to claim 5 wherein each group is an arrangement of rows and columns of adjoining pixels.

7. The method according to claim 5 wherein each group includes a same number of pixels and wherein each pixel in each group corresponds to a pixel in each other group and wherein corresponding pixels are assigned a same offset value of the first plurality.

8. The method according to claim 5 wherein each group includes a same number of pixels positioned in a same arrangement and wherein each pixel in each group corresponds to a pixel in each other group having a same position in the arrangement and wherein corresponding pixels are assigned a same offset value of the first plurality.

9. An apparatus for displaying a display image on a display panel having a plurality of pixels arranged in row and columns, the apparatus comprising:

a. a pixel counter for forming a pixel count value having upper bits and lower bits, wherein the pixel counter is incremented for each pixel in a row;

b. a line counter for forming a line count value having upper bits and lower bits, wherein the line counter is incremented when the pixel count value reaches a maximum count;

c. a first memory store for storing a plurality of block dispersion values wherein an appropriate one of the block dispersion values is selected according to a block identified by the upper bits of the pixel count value and by the upper bits of the line count value;

d. a first adder coupled to add the lower bits of the pixel count value and the lower bits of the line count value in concatenation to the selected dispersion value for forming a first sum; and e. a second memory store for storing a plurality of pixel dispersion values wherein an appropriate one of the pixel dispersion values is selected according to the first sum.

10. The apparatus according to claim 15 further comprising:

a. a second adder coupled to add the selected pixel dispersion value to a value representative of a current sub-frame for a display frame for forming a second sum; and b. a third memory store for storing a plurality of modulation sequences, each modulation sequence corresponding to a grey level for a pixel identified by the pixel count value and line count value, wherein an appropriate one of the modulation sequences is selected according to the display image and wherein an appropriate element of the selected sequence is selected according to the second sum.

* * * * *

UNITED STATES PATENT AND TRADEMARK OFFICE

CERTIFICATE OF CORRECTION

PATENT NO. : 6,175,355 B1
DATED : January 16, 2001
INVENTOR(S) : Reddy

It is certified that error appears in the above-identified patent and that said Letters Patent is hereby corrected as shown below:

Column 8,
Line 52, "15" should be --5--

Signed and Sealed this

Seventeenth Day of July, 2001

Nicholas P. Godici

*Attest:*

*Attesting Officer*

NICHOLAS P. GODICI
*Acting Director of the United States Patent and Trademark Office*